US012338045B2

(12) United States Patent
Grossetete

(10) Patent No.: US 12,338,045 B2
(45) Date of Patent: Jun. 24, 2025

(54) APPARATUS AND METHOD FOR DELAYED ACTIVATION OF ACTIVE AGENT IN CONTAINER HOLDING PRODUCT SENSITIVE TO ENVIRONMENTAL TRIGGER(S)

(71) Applicant: CSP TECHNOLOGIES, INC., Auburn, AL (US)

(72) Inventor: Florence Grossetete, Niederbronn-les-Bains (FR)

(73) Assignee: CSP TECHNOLOGIES, INC., Auburn, AL (US)

( * ) Notice: Subject to any disclaimer, the term of this patent is extended or adjusted under 35 U.S.C. 154(b) by 25 days.

(21) Appl. No.: 17/907,422

(22) PCT Filed: Apr. 1, 2021

(86) PCT No.: PCT/US2021/070346
§ 371 (c)(1),
(2) Date: Sep. 27, 2022

(87) PCT Pub. No.: WO2021/203138
PCT Pub. Date: Oct. 7, 2021

(65) Prior Publication Data

US 2023/0124358 A1 Apr. 20, 2023

Related U.S. Application Data

(60) Provisional application No. 63/004,271, filed on Apr. 2, 2020.

(51) Int. Cl.
*B65D 51/30* (2006.01)
*B65D 43/16* (2006.01)
(Continued)

(52) U.S. Cl.
CPC ..... *B65D 51/30* (2013.01); *B65D 43/162* (2013.01); *B65D 51/20* (2013.01); *B65D 51/247* (2013.01);
(Continued)

(58) Field of Classification Search
CPC ..... B65D 51/30; B65D 43/162; B65D 51/20; B65D 51/247; B65D 2251/0021;
(Continued)

(56) References Cited

U.S. PATENT DOCUMENTS 3,347,403 A * 10/1967 Lehrman ..... A47J 41/0072 250/506.1
5,911,937 A 6/1999 Hekal
(Continued)

FOREIGN PATENT DOCUMENTS

EP 1305230 A1 5/2003

OTHER PUBLICATIONS

International Search Report issued in PCT/US2021/070346, mailed Sep. 13, 2021.
(Continued)

*Primary Examiner* — Andrew D Perreault
(74) *Attorney, Agent, or Firm* — David B. Gornish; Eckert Seamans Cherin & Mellott, LLC

(57) ABSTRACT

A device configured to maintain or preserve products sensitive to environmental triggers, such as moisture or oxygen, can include a lid (24) removably attachable to a body (16) of a container (10) in which the sensitive product (23) is stored. An active agent (12) capable of preventing, or at least slowing, exposure of the sensitive product to the environmental trigger is positioned in or under the lid. A utensil (40) configured to shield the active agent can be removably attached to an underside of the lid and positioned to cover the active agent when the utensil is attached to the lid. Upon
(Continued)

removal of the utensil, the active agent is unshielded and, upon exposure to the environment, is activated to absorb or consume at least some of the environmental triggers within the container.

11 Claims, 2 Drawing Sheets

(51) Int. Cl.
*B65D 51/20* (2006.01)
*B65D 51/24* (2006.01)

(52) U.S. Cl.
CPC ..... *B65D 2251/0021* (2013.01); *B65D 2251/0093* (2013.01)

(58) Field of Classification Search
CPC ..... B65D 2251/0093; B65D 51/22; B65D 51/246; B65D 81/264
USPC ..... 220/219, 220, 221, 222
See application file for complete search history.

(56) References Cited

U.S. PATENT DOCUMENTS

| | | | | |
|---|---|---|---|---|
| 6,080,350 | A | 6/2000 | Hekal | |
| 6,124,006 | A | 9/2000 | Hekal | |
| 6,130,263 | A | 10/2000 | Hekal | |
| 6,174,952 | B1 | 1/2001 | Hekal | |
| 6,194,079 | B1 | 2/2001 | Hekal | |
| 6,214,255 | B1 | 4/2001 | Hekal | |
| 6,221,446 | B1 | 4/2001 | Hekal | |
| 6,486,231 | B1 | 11/2002 | Hekal | |
| 6,929,119 | B2 * | 8/2005 | Shaki ..... | B65D 83/06 215/DIG. 8 |
| 7,005,459 | B2 | 2/2006 | Hekal | |
| 2005/0178677 | A1 * | 8/2005 | Morrow ..... | B65D 51/28 206/219 |
| 2014/0339106 | A1 | 11/2014 | Schanin et al. | |
| 2015/0197381 | A1 | 7/2015 | Valenti et al. | |
| 2016/0039955 | A1 | 2/2016 | Klein et al. | |

OTHER PUBLICATIONS

Written Opinion issued in PCT/US2021/070346, mailed Sep. 13, 2021.

* cited by examiner

APPARATUS AND METHOD FOR DELAYED ACTIVATION OF ACTIVE AGENT IN CONTAINER HOLDING PRODUCT SENSITIVE TO ENVIRONMENTAL TRIGGER(S)

CROSS-REFERENCE OF RELATED APPLICATIONS

This application is a 35 U.S.C. § 371 national phase from PCT International Application No. PCT/US2021/070346, filed Apr. 1, 2021, which claims priority to U.S. Provisional Patent Application No. 63/004,271, entitled "APPARATUS AND METHOD FOR DELAYED ACTIVATION OF ACTIVE AGENT IN CONTAINER HOLDING PRODUCT SENSITIVE TO ENVIRONMENTAL TRIGGER(S)", filed on Apr. 2, 2020, the contents of which are incorporated herein by reference in their entirety.

FIELD

The presently disclosed technology relates generally to storage and/or shipment of environmentally sensitive product and, more particularly, to a container and a method for delaying the exposure of an active agent positioned within the container to certain environmental trigger(s) for extending the shelf life or the useful life of the sensitive product.

BACKGROUND

Consumers and manufacturers frequently attempt to preserve and/or extend the shelf life of moisture sensitive product, particularly after an initial seal is broken or otherwise disrupted.

An example of such efforts is in the baby formula industry. Manufacturers package formula in a container, typically with an aluminum seal beneath a plastic lid. When the consumer desires to access the formula, the plastic lid is first removed from the body of the container, and then the aluminum seal is broken or removed. Once the seal is broken or removed, at least some moisture penetrates into the body of the container, and the formula that remains in the container is typically only consumable for a few days due to its reaction with the moisture. Some consumers turn the container upside down after each use to avoid or delay entry of the moisture, but this solution is not very effective. Often, at least some of the product must be discarded, which is undesirable.

There is a need to increase the shelf life, or otherwise preserve, products that are sensitive to moisture or other environmental conditions that can trigger spoilage or rapid loss of effectiveness or utility. Exemplary sensitive products include, but are not limited to, moisture sensitive products and/or oxygen sensitive products. Exemplary environmental triggers include, but are not limited to, moisture and/or air.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, abstract and drawings as a whole.

In various aspects, the needs described above are addressed by a container configured to maintain or preserve products that are sensitive to environmental triggers. The container may include, for example, a body having a basewall and a sidewall that extends upwardly from the basewall, where the sidewall defines an opening and a cavity that is configured to hold a product sensitive to an environmental trigger. The container also includes a lid removably attachable to the body. In various aspects, the lid is configured to close the opening when the lid is attached to the body. The lid has a basewall and a skirt extending downwardly from an outer periphery of the basewall, at least one projection extending downwardly from an interior surface of the basewall, positioned inwardly, and spaced from the skirt. An active agent is attached, and optionally, removably attached, to the projection. A utensil is releasably attached to the container. The utensil has a portion that is configured to seat on the projection and to shield the active agent from the environmental trigger. The utensil may be removably attachable to the projection.

In certain aspects, the projection may be in the form of an annular member defining an inner space, with the active agent positioned within the inner space of the projection. In certain aspects, the active agent may be press fit into the projection, or optionally held in place with a physical restraint, such as prongs or another engagement member.

In various aspects, the utensil may include a handle, a product removal portion at the end of the handle, and optionally, a first engagement surface, such as a rib, extending outwardly from one or both of the handle and the product removal portion of the utensil. The utensil may be any utensil configured for removing some of the product from the container, sized to fit under the lid or within the opening of the container. For example, the product removal portion of the utensil may be in the form of a spoon, a dipper, a cup, a spatula, a fork, or a pair of tongs, by way of example and without limitation.

The projection of the lid may optionally include a second engagement surface, complementary to the first engagement surface, to attach the utensil to the lid. In an exemplary embodiment, the second engagement surface may be a lip extending outwardly from the projection, and the first engagement surface may be a rib configured to contact the lip of the projection. In various aspects, the projection of the lid has a side wall defining a space and the length of the side wall of the projection is less than the length of the skirt of the lid.

In various aspects, the container may include a sealing cover, such as a foil layer, to cover the opening. The sealing cover may be attached to the body about or proximate the opening thereof.

In various aspects, the cavity of the body of the container may have a lower cavity for storing the sensitive product and an upper cavity. The sealing cover layer may be attached to the body, separating the upper cavity from the lower cavity. In various aspects, at least part of the utensil may be configured to fit within the upper cavity of the container when the lid is attached to the body.

In certain aspects, a container configured to maintain or preserve a moisture sensitive product may include a body having a basewall and a sidewall extending upwardly therefrom, the sidewall defining an opening and a cavity configured to hold a moisture-sensitive product, a lid removably attachable to the body and configured to close the opening when the lid is attached to the body, wherein the lid has a basewall and a skirt extending downwardly from an outer periphery of the basewall, and at least one projection extending downwardly from an interior surface of the basewall. The projection is spaced inwardly from the skirt and an active agent having moisture absorbable or adsorbable properties is removably attachable to the projection. The container includes a utensil in the exemplary form of a spoon, a dipper, a cup, a spatula, a fork, and tongs, which has a portion thereof configured to seat on the projection to shield the active agent from moisture, and optionally at least one other environmental trigger. In various aspects, the utensil may be removably attached or removably attachable to the projection. In various aspects, the utensil may be separately or additionally removably attachable to the lid.

A method is also described herein for maintaining or preserving a product that is sensitive to an environmental trigger. The method in various aspects includes unshielding an active agent housed in a first portion of a container, wherein the active agent is capable of slowing exposure of the sensitive product to the environmental trigger, and exposing the sensitive product housed in a second portion of the container to the active agent.

The method step of unshielding the active agent may comprise releasing a utensil when the utensil is releasably attached to the first portion of the container and is configured for removing an amount of the sensitive product from the second portion of the container.

In various aspects, the environmental trigger is moisture, the product is sensitive to moisture, and the active agent is, or includes, a desiccant. In various aspects, the environmental trigger is air or oxygen in the air, the product is sensitive to oxygen, and the active agent is, or includes, an oxygen scavenger.

In one aspect, the presently disclosed technology is directed to a device configured to maintain or preserve moisture sensitive product. The device can include a lid removably attachable to a body of a container. A utensil can be removably attachable to an underside of the lid. An active agent can be positioned between a portion of the utensil and the underside of the lid when the utensil is attached to the lid. The active agent can be configured to absorb or consume at least some moisture within the container when the utensil is separated from the underside of the lid.

Another aspect of the disclosed and claimed concept is to provide an improved container configured to maintain or preserve a product that is sensitive to an environmental trigger, the container can be generally stated as including a body having a base and further having a sidewall extending from the base, the body having a cavity situated adjacent the sidewall and configured to hold the product, the body further having an opening in communication with the cavity, a lid removably attachable to the body and configured to close the opening when the lid is attached to the body, the lid having a basewall and further having a skirt extending from an outer periphery of the basewall, the lid further having at least one projection extending from the basewall, the at least one projection being adjacent and spaced inwardly from the skirt, the lid further having an active agent situated on the at least one projection, and a utensil having a portion thereof configured to seat on the at least one projection and to shield the active agent from the environmental trigger, the utensil being removably attachable to the at least one projection.

A further aspect of the disclosed and claimed concept is to provide an improved method of maintaining or preserving a product that is sensitive to an environmental trigger, the product being situated in a container having a first portion and a second portion, the container further having a utensil that is usable for removing an amount of the product from the second portion and that is releasably attached to the first portion, the method can be generally stated as including releasing the utensil from the first portion and thereby unshielding an active agent that is housed in the first portion and that is structured to resist exposure of the product to the environmental trigger, and exposing the product housed in the second portion to the active agent.

It should be understood that this disclosure is not limited to the embodiments disclosed in this Summary, and it is intended to cover modifications that are within the spirit and scope of the disclosed and claimed concept, as defined by the claims.

BRIEF DESCRIPTION OF THE DRAWINGS

The foregoing summary, as well as the following detailed description of the presently disclosed technology, will be better understood when read in conjunction with the appended drawings in which like reference numerals designate like elements. It should be understood, however, that the presently disclosed technology is not limited to the precise arrangements of elements shown. In the drawings.

DETAILED DESCRIPTION

Figure 1:
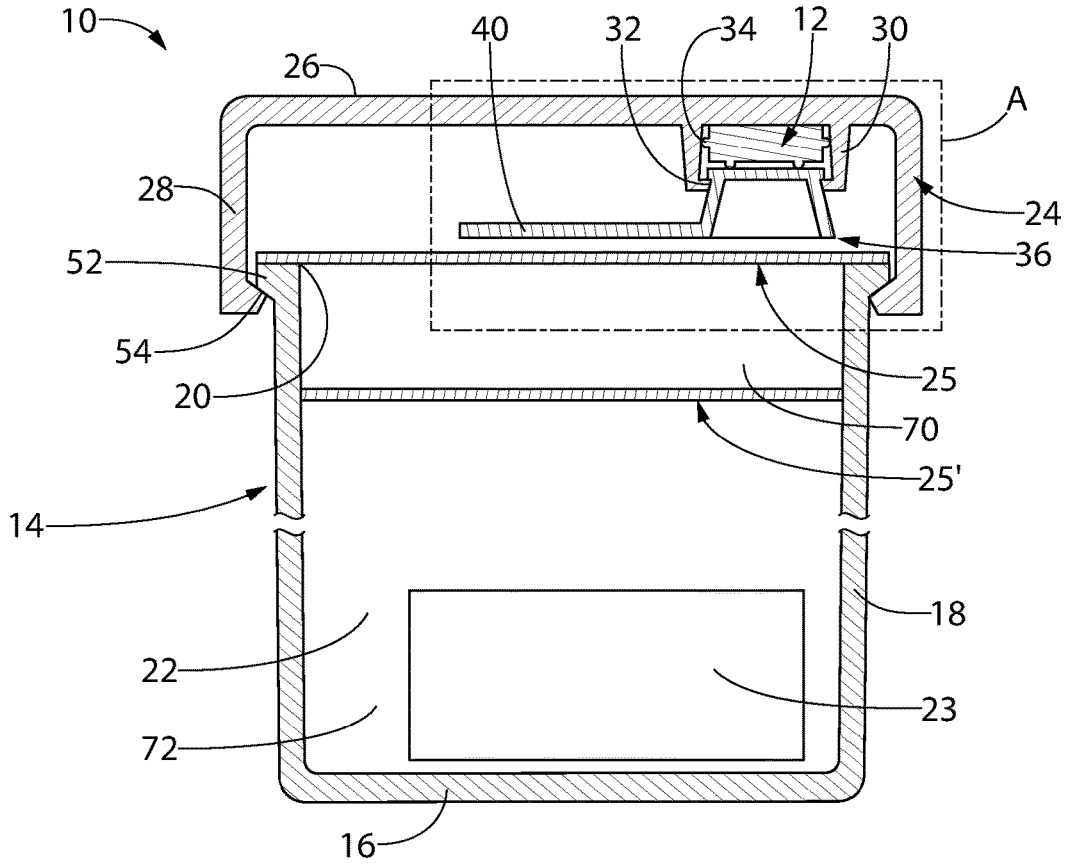
FIG. 1 is a schematic, cross-sectional side elevation view of a container according to one embodiment of the presently disclosed technology, wherein a lid of the container is shown in a closed position, a utensil is shown attached to the lid, and two embodiments of an optional sealing layer are shown.

While systems, devices and methods are described herein by way of examples and embodiments, those skilled in the art recognize that the presently disclosed technology is not limited to the embodiments or drawings described. Rather, the presently disclosed technology covers all modifications, equivalents and alternatives falling within the spirit and scope of the appended claims. Features of any one embodiment disclosed herein can be omitted or incorporated into another embodiment.

Any headings used herein are for organizational purposes only and are not meant to limit the scope of the description or the claims. As used herein, the word "may" is used in a permissive sense (i.e., meaning having the potential to) rather than the mandatory sense (i.e., meaning must). Unless specifically set forth herein, the terms "a," "an" and "the" are not limited to one element but instead should be read as meaning "at least one." The terminology includes the words noted above, derivatives thereof and words of similar import.

Directional phrases used herein, such as, for example and without limitation, top, bottom, left, right, lower, upper, front, back, and variations thereof, shall relate to the orientation of the elements shown in the accompanying drawing and are not limiting upon the claims unless otherwise expressly stated.

In the present application, including the claims, other than where otherwise indicated, all numbers expressing quantities, values or characteristics are to be understood as being modified in all instances by the term "about." Thus, numbers may be read as if preceded by the word "about" even though the term "about" may not expressly appear with the number.

Accordingly, unless indicated to the contrary, any numerical parameters set forth in the following description may vary depending on the desired properties one seeks to obtain in the compositions and methods according to the present disclosure. At the very least, and not as an attempt to limit the application of the doctrine of equivalents to the scope of the claims, each numerical parameter described in the present description should at least be construed in light of the number of reported significant digits and by applying ordinary rounding techniques.

Any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

Referring now in detail to the various figures, wherein like reference numerals refer to like parts throughout, FIGS. 1-4 illustrate embodiments of a container, generally designated 10, that includes a first portion and a second portion. In various aspects, the first portion is a lid 24. In various aspects, the second portion is a body 16, configured, for example, to store product 23 sensitive to one or more environmental triggers. More particularly, the container 10 is designed to allow a user or consumer to selectively unshield or expose an active agent 12. A blocker 36, optionally in the form of a utensil, shields and preserves the active agent 12 when not needed and, when the blocker 36 is removed, allows the active agent 12 to be activated when needed or desired. The utensil 36, as shown in the Figures, may be held under the lid 24 or within an upper cavity 70 of the container or partially in both, for example, but the presently disclosed technology is not limited to the blocker 36 being positioned in a specific location within the container 10.

One embodiment of a device or system of the presently disclosed technology for maintaining or preserving the product 23 that is sensitive to one or more environmental triggers that are capable of reducing the shelf life of the product 23, or of spoiling, or altering the product, includes the active agent 12 capable of preventing, or at least slowing exposure of the sensitive product to the one or more environmental triggers. The active agent 12 in various aspects may be, for example, a desiccant or an oxygen scavenger. The active agent 12 may be placed in or under the lid 24 of a container 10. The active agent in various aspects, is tightly protected from exposure to the environmental trigger within the container lid 24 by a portion 38 of the utensil 36 (such as, but not limited to, spoons, dippers, cups, spatulas, forks, tongs, etc.) while the container 10 is in storage, and at least as long as the storage life of the sensitive product 23 within the container.

In addition to the lid 24, the container 10 can include a seal 25, optionally positioned over or at the opening 20 of the container 10, to form a seal and/or to protect the product 23 in the container 10 during storage. When the container lid 24 is opened by an end user, such as a consumer, the optional seal 25 can be removed before or after the utensil 36 is removed or separated from the lid 24. When the utensil 36 is removed, the active agent 12 is exposed to the environment including the environmental triggers, and is thereby activated.

For example, if the product 23 is a moisture-sensitive product, the active agent 12 may be a desiccant, and upon exposure to the product 23 in the container 10 after the seal 25 is removed, and/or upon exposure to moisture in the air, the desiccant is activated and starts the adsorption or absorption of moisture to protect the moisture sensitive product 23 in the container 10 until the container is empty. The product 23 may for example, be infant formula, powdered milk, powdered cocoa and the like. The product 23 may optionally be a non-food item that is moisture sensitive.

In various aspects, an embodiment of the system or device of the presently disclosed technology may include the container 10 configured to maintain or preserve products that are sensitive to environmental triggers. The container, for example, may include a body 14 having a base 16 and a sidewall 18 that extends upwardly from the base 16, where the sidewall 18 defines the opening 20 and a cavity 22 that is configured to hold the product 23 sensitive to an environmental trigger. The cavity 22 is adjacent the sidewall 18, and the opening 20 is in communication with the cavity 22. The container 10 also includes the lid 24 removably attachable to the body 14. In various aspects, the lid 24 is configured to close the opening 20 when the lid 24 is attached to the body 14. The lid 24 has a basewall 26 and a skirt 28 extending downwardly from an outer periphery of the basewall 26, at least one projection 30 extending downwardly from an interior surface of the basewall 26, and positioned inwardly and spaced from the skirt 28. The active agent 12 can be attached, and optionally removably attached, to the projection 30. The utensil 36 can be provided with the container 10. The utensil 36 has a portion 38 that is configured to seat on the projection 30 and shield and/or seal the active agent 12 from the environmental trigger. The utensil 36 may be removably attachable or may be removably attached to the projection 30.

The lid 24 may be a fully removable lid or may be attached to a body 16 of the container by a hinge 64 or other tether.

The active agent 12 may be in any geometric form that will fit within the projection 30 in or under the lid 24. For example, the active agent 12 may be in the form of a tablet, a disc, a block, a sphere, multiple spheres, or portions of a sphere, or a puck-like shape. For convenience, the active agent 12 will sometimes be referred to herein as a puck. Those skilled in the art will recognize, however, that, as stated, any suitable shape that fits in or can be held by the projection 30 will suffice. The puck can be assembled separately from the lid and then mechanically attached thereto, or the puck could be overmolded into the lid, for example.

Optionally, when the utensil 36 is attached to the lid 24, the puck 12 is thereby sealed from the external environment or the remainder of the interior of the container 10, thereby preventing or delaying the active agent capabilities of the puck.

Figure 4:
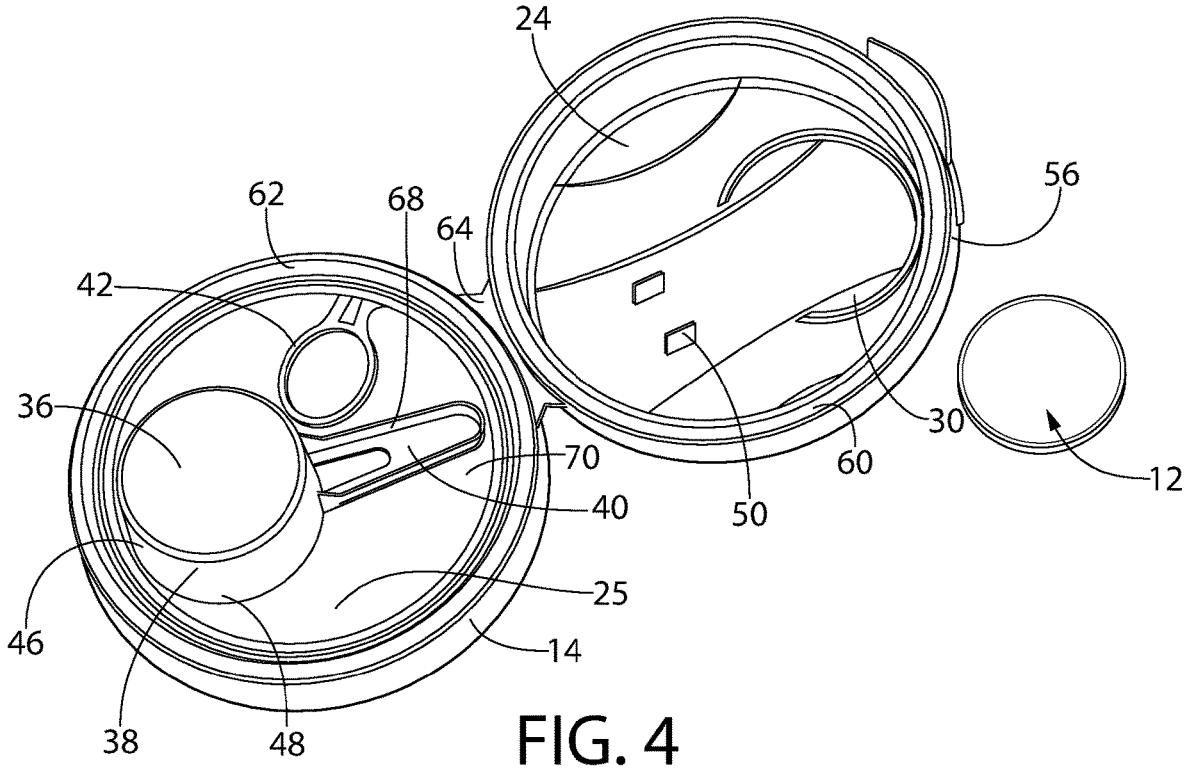
FIG. 4 is a view similar to that of FIG. 3, wherein a puck formed from or containing an active agent is separated from a lid of the container.

Optionally, the utensil 30 can include a first engagement member, such as a rib 68 extending outwardly from a portion (e.g., the bottom) thereof, as shown in FIG. 4. The first engagement member 68 of the utensil 36 can engage a second complementary engagement member 50 of the lid 24 for complementary releasable engagement with the first engagement member 68 of utensil 36. The exemplary second engagement member 50 includes, without limitation, at least one, and optionally two or more, projections extending outwardly from the basewall 26 of lid 24. Engagement and disengagement of the first and second engagement members 68, 50 allows the utensil 36 to be removably attachable to the lid 24. In various aspects, a portion 38 of the utensil 36 that is configured for removing product 23 from the container body 14 seats on, or partially in, the projection 30 to create a seal between the projection 30 and the portion 38 of the utensil 36 to prevent the active agent 12 held in the projection 30 from being exposed to the environmental trigger or triggers.

In various aspects, the environmental trigger may be moisture and the active agent is or contains a desiccant. Absorption of moisture, for example, can start immediately after the utensil 36 is separated from the lid 24, thereby exposing the puck 12 to the environment surrounding the container 10 and the contents of the container 10. One benefit of this design is that it avoids the use of a separate seal or structure to seal the puck 12 during the storage life. Optionally, the container 10 can include a sealing layer 25, such as a layer of foil, which can be punctured or removed from the container 10 before or after the utensil 36 is separated from the lid 24.

Optionally, the weight of desiccant is sufficient to preserve or maintain the moisture sensitive product during the targeted shelf life of the product 23. In certain aspects, when the product 23 is a type of food, such as infant formula, the target shelf life may be 15 days, the anticipated time it takes to use the product and empty the container.

The presently disclosed technology is not limited to use with a particular type of sensitive product. When the environmental trigger is moisture, examples of moisture sensitive product that can benefit from or be used with the presently disclosed technology include, but are not limited to, infant formula, animal food, such as but not limited to dog food, iced tea mix, powdered cocoa, and the like. When the environmental trigger is oxygen, the active agent may be, or include, an oxygen scavenger for preventing the growth of mold, fungus, and bacteria in pre-packaged foods. Certain pharmaceutical products or test strips may also be sensitive to moisture and/or oxygen, or other environmental triggers.

The container 10 can include the lid 24 that is removably attachable to the body 14. The lid 24 can optionally be formed of a polymeric material. More particularly, the lid 24 can removably engage and/or contact an upper rim or the sidewall 18 of the body 14. The lid 24 is configured to close the opening 20 when the lid 24 is attached to the body 14. The lid 24 shown herein can be completely separated from the body 14. However, in an alternative embodiment, a hinge 64, as shown in FIGS. 3 and 4, or other form of tether can pivotably attach the lid 24 to the body 14.

Figure 2:
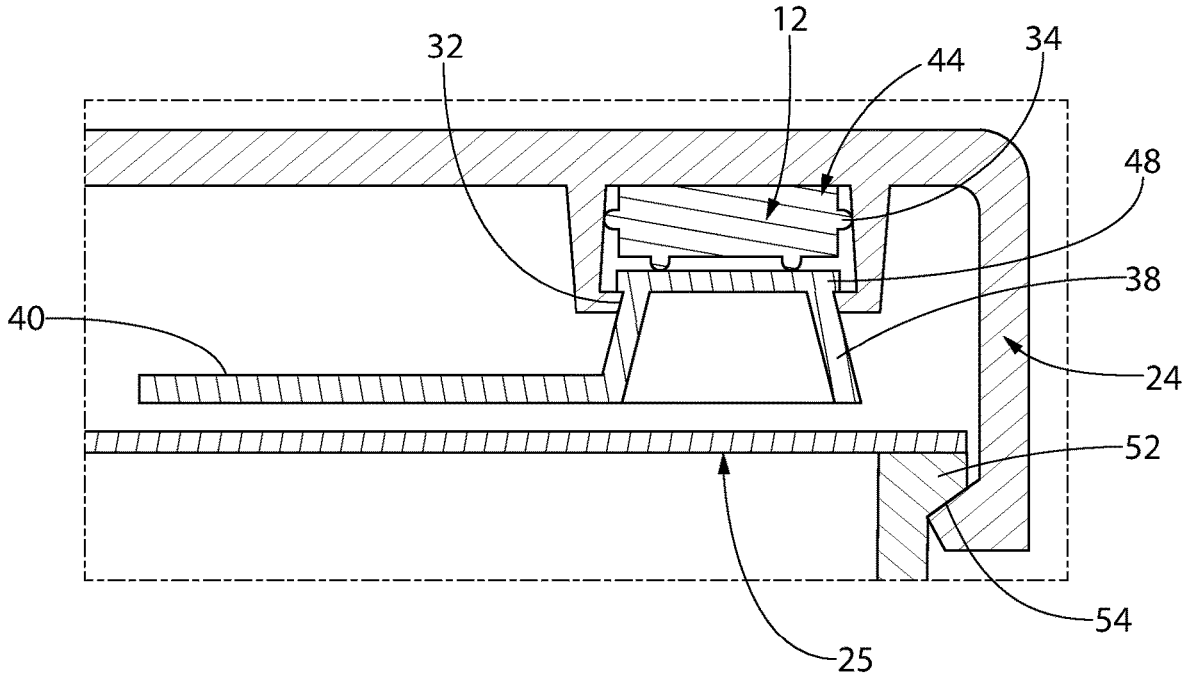
FIG. 2 is a magnified view of box A shown in broken lines in FIG. 1.

The lid 24 can include the basewall 26 and the skirt 28 extending downwardly from an outer periphery of the basewall 26. The skirt 28 can be relatively long, as shown in FIGS. 1 and 2, or much shorter or compact, an example of which is shown in FIGS. 3 and 4.

Optionally, when engaged or attached, the lid 24 and body 14 can form a seal. Referring to FIGS. 1 and 2, in certain aspects, the lid 24 may include an inwardly directed rim, or flange, 54 with a curved edge that is configured to contact a complementary curved surface of a lip 52 on the upper edge of the container body 14. Optionally, the contact area where the lip 52 and the flange 54 meet forms a seal, which both contains the product within the container 10 and seals the container 10 against moisture or exposure to other environmental triggers when the lid 24 is closed onto the body 14.

Figure 3:
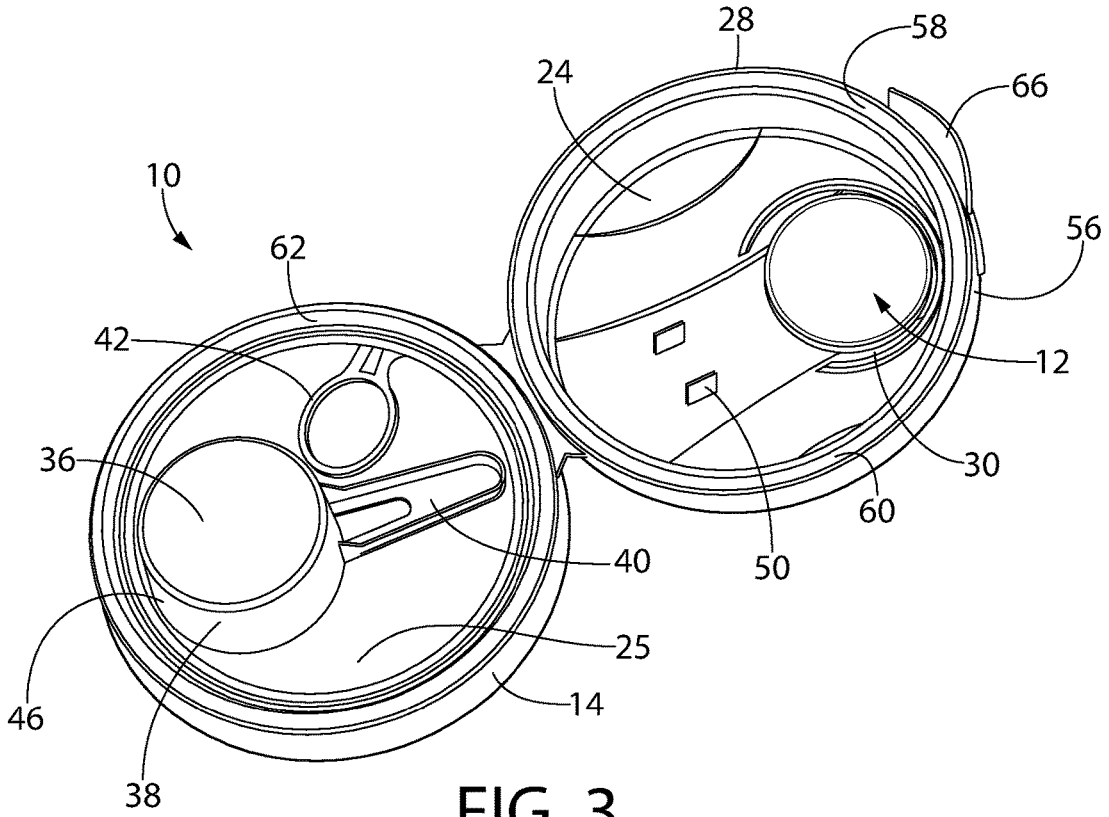
FIG. 3 is a perspective view of a container according to an alternative embodiment of the presently disclosed technology, wherein the lid is shown in an open position and the utensil is shown separated from the lid.

In various aspects, as shown in FIGS. 3 and 4, the skirt 28 of the lid 24 may include an inner skirt wall 58 and an outer skirt wall 56 defining a space 60 between the skirt walls 56, 58. The body 14 of the container 10 optionally includes a sealing ring 62 that extends upwardly from the top edge of body 14 and that is configured to fit within the space 60 between, and in contact with, skirt walls 56, 58, thereby sealing the container against exposure to moisture or exposure to other environmental triggers when the lid 24 is closed onto the body 14. Optionally, the location of the sealing ring 62 and skirt walls 56, 58 can be reversed, if desired, such that the sealing ring 62 can be located on the lid 24 and the skirt walls 56, 58 can be located on the body 14.

However, in various aspects, if the seal between the lip 52 and the flange 54 and/or between the sealing ring 62 and skirt walls 56, 58 is not moisture or air tight, an optional sealing layer 25 can be located at, or adjacent to, an upper end of the body 14 and form a moisture and/or oxygen tight seal with the sidewall 18 of the body 14. The sealing layer 25 can be formed partially or completely of foil. In an alternative embodiment, the sealing layer 25 can be used even if the seal between the lip 52 and the flange 54 and/or between the sealing ring 62 and skirt walls 56, 58 is moisture or air tight, so as to provide additional or back-up protection.

As shown in FIGS. 3 and 4, a tab 42 can be attached to at least a portion of a periphery of the sealing layer 25, and can be designed to help a user break or remove the seal created by the sealing layer 25.

In certain aspects, the body 14 of the container 10 may have an upper cavity 70 and a lower cavity 72 where the sensitive product 23 is stored. In embodiments having a sealing layer, a layer 25' may optionally be positioned at the juncture between the upper 70 and lower 72 cavities. Both layers 25 and 25' are shown in FIG. 1 for convenience of illustration. In practice, typically only one layer 25 or 25' would be used in a container 10.

As shown in FIGS. 3 and 4, in various aspects, the utensil 36 may be stored in the upper cavity 70 of the body 14. This arrangement is particularly useful when the lid 24 is compact with a shorter skirt 28, or when the utensil includes a product removal portion 38 that is deeper than the length of skirt 28 such that more space than is available beneath the lid 24 is needed for storage of the utensil 36. Examples of a product removal portion requiring more space is a dipper or cup shaped removal portion, such as that shown in FIGS. 1 and 2, if it were to be used in the lid configuration shown in FIGS. 3 and 4.

In one embodiment, at least one projection 30 can extend downwardly from an interior surface of the basewall 26 of the lid 24. The projection 30 can be spaced apart from, and spaced inwardly with respect to, the skirt 28. Optionally, the projection 30 can be in the shape of a continuous annular ring or annular member defining a projection cavity 44. The projection 30 can be integrally and/or monolithically formed with the lid 24, or the projection 30 can be attached to the lid 24 by some fastening device, such as an amount of adhesive.

The active agent 12 can be removably attachable to the projection 30. Optionally, the active agent 12 can be positioned within the projection cavity 44 and surrounded by the projection 30. In one embodiment, the active agent 12 is press-fit or friction-fitted into the projection 30. The active agent 12 can be in the form of a puck having at least one extension or ridge 34 extending outwardly from the puck 12. Optionally, the ridge 34 can extend around the entire periphery of the puck. Alternatively, optionally, two or more discrete, spaced-apart and/or separate ridges 34 can be located on the puck. Each ridge 34 can tightly engage an interior surface of the projection 30 to wedge the puck 12 into the cavity 44 to at least help the active agent 12 remain within the projection 30. In addition, the ridges 34 create space around the puck 12 so that more of the surface area of the active agent is exposed for performing its function.

As shown in FIGS. 1 and 2, in one embodiment, the projection 30 can include a first engagement surface, such as a lip 32. Optionally, the lip 32 can extend inwardly around the entire periphery of the projection, e.g., parallel to the basewall 26 of the lid 24. The lip 32 can be continuous around the lower edge of the projection, or may be a plurality of discontinuous segments 32 spaced from each other around the lower edge of the projection. The lip 32 can function as an engagement surface to releasably engage a utensil 36 and/or as a seal in combination with a portion of the utensil 36. Optionally, the utensil 36 is configured and positioned to shield the puck 12, and thereby the active agent, from environmental triggers until the product 23 is exposed to the environment surrounding the container 10, and the utensil 36 is released to activate the active agent 12 upon its exposure to the environment surrounding the container and to the product 23 within the container 10.

Optionally, the utensil 36 includes a portion 38 configured for removing a quantity of product from the container 10 and a handle 40. In various aspects, the portion 38 may be configured to seat at or within the opening of the projection 30, beneath the puck 12. In various alternative aspects, the handle 40 may be configured to seat on the opening of the projection 30, beneath the puck 12. In either aspect, the utensil 36 shields the puck 12 from the environment until the utensil is removed, or released from engagement with the lid 24, and in various aspects, from the projection 30.

The removal portion 38 of utensil 36 is shown in FIGS. 1-4 as a scoop, in the form of a cup-shaped dipper or spoon. However, the utensil 36 is not so limited. For example, the utensil 36 could be a fork, a spatula, a pair of tongs, or any other object that could assist the user in removing at least a portion of the product from the cavity 22 of the body 14. In such embodiments, the removal portion 38 may be formed by the relatively flat side of tongs, the broader side of a spatula, or the solid area from which the tines of a fork extend.

In the embodiment of utensil 36 shown in the Figures, the removal portion 38 includes a sidewall extending away from a base wall. A free end of the sidewall forms a concave opening of a bowl or cup for holding product when the utensil is used for product removal. In certain aspects, the utensil 36 may fit within, or partially within, the upper cavity 70 of the cavity 22 of the body 14 when the lid 24 is attached to the body 14. In certain aspects, the utensil 36 may fit fully within the lid 24. The utensil 36 can also be removably attachable to the projection 30. In certain aspects, at least a portion of the utensil 36 may be removably attachable and/or positioned partially within the projection 30.

As shown in FIG. 2, at least one first engagement surface, such as a rib 48, can extend outwardly from the sidewall or base of the removal portion 38 of utensil 36. Optionally, the first engagement surface 48 can extend around the entire periphery of the product removal portion 38 of the utensil 36. Alternatively, optionally, two or more discrete, spaced-apart and/or separate first engagement surfaces 48 can be located on the utensil 36. The first engagement surface 48 of the utensil 36 can be configured for complementary engaging contact with a second engagement surface, such as a lip 32, of the projection 30 to attach the utensil 36 to the lid 24 and/or seal the active agent 12 therebetween.

In an alternative arrangement, as shown in FIGS. 3 and 4, the upper edge of body 16 around the opening 20 may optionally include engagement prongs or tabs 46 to function as the second engagement surface to releasably engage the first engagement surface 48 of the removal portion 38 of the utensil 36. In this embodiment, the utensil 36 is positioned at least in part in the upper cavity 70 of the body 16 of container 10 and optionally, partially within the area of lid 24 defined by inner skirt wall 58. The active agent 12 is shown in FIGS. 3 and 4 as being removable from the projection 30 of lid 24.

In one exemplary embodiment, the active agent includes an agent that prevents or slows the exposure of the sensitive product to certain environmental triggers. For example, the active agent may be a desiccant or an oxygen scavenger. Additionally, as disclosed herein, the active agent is optionally a generally planar member. Alternatively, the active agent is optionally a curved disc-like member, either convexly curved or concavely curved. In one embodiment, the active agent is a desiccant entrained polymer that is a unitary component made of a single piece of material. An entrained polymer, whether entrained with desiccant or another active agent may include a base polymer, e.g., for structure, a desiccant or other active agent, and optionally a channeling agent. These types of active entrained polymers and methods of making and using the same are disclosed, e.g., in U.S. Pat. Nos. 5,911,937, 6,214,255, 6,130,263, 6,080,350, 6,174,952, 6,124,006 and 6,221,446, and U.S. Pat. Pub. No. 2016/0039955, all of which are incorporated by reference herein in their entireties. Optionally, the entrained polymer may be in the form of a film that is loose or optionally heat staked to a surface of the lid, for example.

Alternatively, the desiccant may include loose desiccant beads or a sachet containing the same. While the exemplary embodiment herein reflects the active agent being located within a portion of the lid, it is contemplated that an active agent might be located in other locations or on other structures, such as on a sidewall of the body of the container.

In the embodiment where the active agent, sometimes referred to herein as "active member," contains a desiccant, moisture absorption is desired. However, where moisture absorption is not desired, the active member can include alternative active agents. For example, in another embodiment, the active member may contain activated carbon, carbon black, ketjenblack, and/or diamond powder, by way of example. In a further embodiment, an active agent including one or more layers of the active member contains a material such as absorption microspheres, $BaTiO_3$, $SrTiO_3$, $SiO_2$, $Al_2O_3$, ZnO, $TiO_2$, MnO, CuO, $Sb_2O_3$, silica, calcium oxide, and ion exchange resins.

In yet another embodiment, the absorbing agent can contain two or more types of absorbing agents. The suitable absorbing agent is chosen to achieve absorption of a desired vapor or gas for a desired end use (e.g. absorption of moisture, oxygen, carbon dioxide, nitrogen, or other undesired gases or vapors).

The active member (whether desiccant, oxygen scavenger, a releasing material or ingredient, etc., or combination thereof) is capable of acting on, interacting with, or reacting with a selected material (e.g., moisture or oxygen). Examples of such actions or interactions may include absorption, adsorption (sorption, generally), or release of the selected material. Each active member can be extruded or molded, for example. Optionally, the active member can be formed in a desired shape or pattern (e.g., on a backing) via an in-line melt adhesion thermal bonding process.

The active member can include an "active ingredient" in a base material. The active ingredient(s) (i) can be immiscible with the base material (e.g., polymer) and, when mixed and heated with the base polymer and a channeling agent, will not melt, i.e., has a melting point that is higher than the melting point for either the base polymer or the channeling agent, and/or (ii) acts on, interacts with, or reacts with a selected material. The term "active ingredient" may include but is not limited to materials that absorb, adsorb, or release the selected material(s). Active ingredients according to the presently disclosed technology may be in the form of particles such as minerals (e.g., molecular sieve or silica gel, in the case of desiccants), but the presently disclosed technology should not be viewed as limited only to particulate active agents. For example, in some embodiments, an oxygen scavenging formulation may be made from a resin which acts as, or as a component of, the active agent.

As used herein, the term "base material" is a component (preferably a polymer) of an entrained active material, other than the active agent, that provides structure for the entrained material.

As used herein, the term "base polymer" is a polymer optionally having a gas transmission rate of a selected material that is substantially lower than, lower than, or substantially equivalent to, that of the channeling agent. By way of example, such a transmission rate would be a water vapor transmission rate in embodiments where the selected material is moisture and the active ingredient is a water-absorbing desiccant. The primary function of the base polymer is to provide structure for the entrained polymer. Suitable base polymers may include thermoplastic polymers, e.g., polyolefins such as polypropylene and polyethylene, polyisoprene, polybutadiene, polybutene, polysiloxane, polycarbonates, polyamides, ethylene-vinyl acetate copolymers, ethylene-methacrylate copolymer, poly(vinyl chloride), polystyrene, polyesters, polyanhydrides, polyacrylonitrile, polysulfones, polyacrylic ester, acrylic, polyurethane, and polyacetal, or copolymers or mixtures thereof.

Referring to such a comparison of the base polymer and channeling agent water vapor transmission rate, in one embodiment, the channeling agent has a water vapor transmission rate of at least two times that of the base polymer. In another embodiment, the channeling agent has a water vapor transmission rate of at least five times that of the base polymer. In another embodiment, the channeling agent has a water vapor transmission rate of at least ten times that of the base polymer. In still another embodiment, the channeling agent has a water vapor transmission rate of at least twenty times that of the base polymer. In still another embodiment, the channeling agent has a water vapor transmission rate of at least fifty times that of the base polymer. In still another embodiment, the channeling agent has a water vapor transmission rate of at least one hundred times that of the base polymer.

As used herein, the term "channeling agent" or "channeling agents" is defined as a material that is immiscible with the base polymer and has an affinity to transport a gas phase substance at a faster rate than the base polymer. Optionally, a channeling agent is capable of forming channels through the entrained polymer when formed by mixing the channeling agent with the base polymer. Optionally, such channels are capable of transmitting a selected material through the entrained polymer at a faster rate than in solely the base polymer.

As used herein, the term "channels" or "interconnecting channels" is defined as passages formed of the channeling agent that penetrate through the base polymer and may be interconnected with each other.

As used herein, the term "entrained polymer" is defined as a monolithic material formed of at least a base polymer with an active agent and optionally also a channeling agent entrained or distributed throughout. An entrained polymer thus includes two-phase polymers and three phase polymers. A "mineral loaded polymer" is a type of entrained polymer, wherein the active agent is in the form of minerals, e.g., mineral particles such as molecular sieve or silica gel. The term "entrained material" is used herein to connote a monolithic material comprising an active agent entrained in a base material wherein the base material may or may not be polymeric.

As used herein, the term "monolithic," "monolithic structure" or "monolithic composition" is defined as a composition or material that does not consist of two or more discrete macroscopic layers or portions. Accordingly, a "monolithic composition" does not include a multi-layer composite.

As used herein, the term "phase" is defined as a portion or component of a monolithic structure or composition that is uniformly distributed throughout, to give the structure or composition it's monolithic characteristics.

As used herein, the term "selected material" is defined as a material that is acted upon, by, or interacts with, or reacts with an active agent and is capable of being transmitted through the channels of an entrained polymer. For example, in embodiments in which a desiccant is used as an active agent, the selected material may be moisture or a gas that can be absorbed by the desiccant. In embodiments in which a releasing material is used as an active agent, the selected material may be an agent released by the releasing material, such as moisture, fragrance, or an antimicrobial agent (e.g., chlorine dioxide). In embodiments in which an adsorbing material is used as an active ingredient, the selected material may be certain volatile organic compounds and the adsorbing material may be activated carbon.

As used herein, the term "three phase" is defined as a monolithic composition or structure including three or more phases. An example of a three phase composition according to the presently disclosed technology would be an entrained polymer formed of a base polymer, active agent, and channeling agent. Optionally, a three phase composition or structure may include an additional phase, e.g., a colorant.

Entrained polymers may be two phase formulations (i.e., comprising a base polymer and active ingredient, without a channeling agent) or three phase formulations (i.e., comprising a base polymer, active agent and channeling agent). Entrained polymers are described, for example, in U.S. Pat. Nos. 5,911,937, 6,080,350, 6,124,006, 6,130,263, 6,194,079, 6,214,255, 6,486,231, 7,005,459, and U.S. Pat. Pub. No. 2016/0039955, each of which is hereby incorporated by reference in its entirety.

An entrained material or polymer includes a base material (e.g., polymer) for providing structure, optionally a channeling agent and an active agent. The channeling agent forms microscopic interconnecting channels through the entrained polymer. At least some of the active ingredient is contained within these channels, such that the channels communicate between the active ingredient and the exterior of the entrained polymer via microscopic channel openings formed at outer surfaces of the entrained polymer. The active ingredient can be, for example, any one of a variety of absorbing, adsorbing, or releasing materials, as described in further detail below. While a channeling ingredient is preferred, the presently disclosed technology broadly includes entrained materials that optionally do not include channeling agents, e.g., two phase polymers.

In any embodiment, suitable channeling agents may include a polyglycol such as polyethylene glycol (PEG), ethylene-vinyl alcohol (EVOH), polyvinyl alcohol (PVOH), glycerin polyamine, polyurethane and polycarboxylic acid including polyacrylic acid or polymethacrylic acid. Alternatively, the channeling agent can be, for example, a water insoluble polymer, such as a propylene oxide polymerisate-monobutyl ether, such as Polyglykol B01/240, produced by CLARIANT. In other embodiments, the channeling agent could be a propylene oxide polymerisate monobutyl ether, such as Polyglykol B01/20, produced by CLARIANT, propylene oxide polymerisate, such as Polyglykol D01/240, produced by CLARIANT, ethylene vinyl acetate, nylon 6, nylon 66, or any combination of the foregoing.

Suitable active ingredients according to the presently disclosed technology include absorbing materials, such as desiccating compounds. If the active agent is a desiccant, any suitable desiccant for a given application may be used. Typically, physical absorption desiccants are preferred for many applications. These may include molecular sieves, silica gels, clays and starches. Alternatively, the desiccant may be a chemical compound that forms crystals containing water or compounds which react with water to form new compounds.

Optionally, in any embodiment, the active agent may be an oxygen scavenger, e.g., an oxygen scavenging resin formulation.

In one embodiment, the presently disclosed technology includes a method of maintaining or preserving a product 23 that is sensitive to environmental triggers. The method can include means for delaying activation of adsorption or absorption of such environmental triggers in a container holding the sensitive product.

In another embodiment, the method can include removing a lid 24 from a body 14 of a container 10. The method can include removing a utensil 36 attached to a first portion of the container 10, such as the underside of the lid 24, thereby exposing an active agent 12. Optionally, the method can include removing a sealing layer 25, 25' from a second portion of a container 10, such as from the body 14 of the container 10, which can be accomplished before or after the utensil 36 is separated from the lid 24. The utensil 36 can be used to remove at least some sensitive product 23 from the second portion of the container 10, such as from a cavity 22 of the body 14. The utensil 36 can then be placed in the cavity 22 of the body 14 (possibly on the remaining sensitive product therein) and the lid 24 can be reattached to the body 16, thereby sealing the container 10 and allowing the active agent 12 to consume at least some environmental trigger components within the container 10 to preserve or prolong the shelf-life of the sensitive product 23 within the container 10.

The following exemplary embodiments further describe optional aspects of the presently disclosed technology and are part of this Detailed Description. These exemplary embodiments are set forth in a format substantially akin to claims (each with numerical designations followed by the letter A), although they are not technically claims of the present application. The following exemplary embodiments refer to each other in dependent relationships as "embodiments" instead of "claims."

1A. A device configured to maintain or preserve moisture sensitive product, the device comprising:

a lid removably attachable to a body of a container, a utensil removably attachable to an underside of the lid, an active agent positioned between a portion of the utensil and the underside of the lid when the utensil is attached to the lid, the active agent being configured to absorb or consume at least some moisture within the container when the utensil is separated from the underside of the lid.

1B. The device of embodiment 1A, wherein the body includes a cavity holding moisture sensitive product.

2A. A method of maintaining or preserving a product that is sensitive to an environmental trigger, the method comprising:

unshielding an active agent housed in a first portion of a container, the active agent being capable of slowing exposure of the sensitive product to the environmental trigger;

exposing the sensitive product housed in a second portion of the container to the active agent.

2B. The method of embodiment 2A wherein the container includes a utensil releasably attached to the first portion of the container for removing an amount of the sensitive product from the second portion of the container, and the step of unshielding the active agent comprises releasing the utensil.

2C. The method of the embodiments of 2A or 2B wherein the first portion of the container is a lid.

2D. The method of the embodiments of 2A, 2B, or 2C wherein the second portion of the container comprises a body having a base and a sidewall extending upwardly therefrom, the sidewall defining an opening and a cavity configured to hold sensitive product.

3A. A method of maintaining or preserving moisture sensitive product, the method comprising:

removing a lid from a body of a container;

removing a utensil from an underside of the lid to expose an active agent attached to the underside of the lid;

removing, via the utensil, some moisture sensitive product from a cavity of the body; placing the utensil in the cavity; and reattaching the lid to the body to seal the active agent and remaining moisture sensitive product within the cavity.

3B. The method of embodiment 3A, wherein the active agent is configured to absorb or consume at least some moisture within the sealed cavity.

4A. A method of maintaining or preserving product, the method comprising delaying activation of adsorption of moisture in a container holding moisture sensitive product.

5A. A method of maintaining or preserving product in a container, the method comprising exposing a previously concealed active agent attached to a portion of the container to adsorb or absorb moisture in the container and/or emanating from product in the container.

6A. A method delaying activation of adsorption of moisture in a container holding moisture sensitive product, the method comprising exposing a previously concealed active agent attached to a portion of the container.

The disclosed and claimed concept has been described with reference to various exemplary and illustrative embodiments. The embodiments described herein are understood as providing illustrative features of varying detail of various embodiments of the disclosed and claimed concept; and therefore, unless otherwise specified, it is to be understood that, to the extent possible, one or more features, elements, components, constituents, ingredients, structures, modules, and/or aspects of the disclosed embodiments may be combined, separated, interchanged, and/or rearranged with or relative to one or more other features, elements, components, constituents, ingredients, structures, modules, and/or aspects of the disclosed embodiments without departing from the scope of the disclosed and claimed concept. Accordingly, it will be recognized by persons having ordinary skill in the art that various substitutions, modifications or combinations of any of the exemplary embodiments may be made without departing from the scope of the disclosed and claimed concept. In addition, persons skilled in the art will recognize, or be able to ascertain using no more than routine experimentation, many equivalents to the various embodiments of the disclosed and claimed concept described herein upon review of this specification. Thus, the disclosed and claimed concept is not limited by the description of the various embodiments, but rather by the claims.

What is claimed is:

1. A method of maintaining or preserving a product that is sensitive to an environmental trigger, the product being situated in a container having a first cavity and a second cavity, the product being stored in the second cavity, the container further having a utensil that is usable for removing an amount of the product from the second cavity and that is releasably attached to a housing defining the first cavity, the first cavity being devoid of any of the product while the utensil is releasably attached to the housing, the utensil comprising a concave product removal portion and a handle portion extending from the product removal portion, the utensil enclosing the first cavity while the utensil is releasably attached to the housing, the method comprising:

releasing and removing the utensil from the housing and thereby unshielding an active agent that is housed in the first cavity, the active agent being structured to reduce exposure of the product to the environmental trigger, the utensil retaining its original shape as it is released and removed from the housing; and exposing the product housed in the second cavity to the active agent, thereby reducing exposure of the product to the environmental trigger in order to maintain or preserve the product.

2. The method of claim 1, wherein the environmental trigger is moisture and wherein the product is sensitive to moisture.

3. The method of claim 2, wherein the active agent is a desiccant.

4. The method of claim 1, wherein the first cavity is on a lid.

5. The method of claim 1, wherein the second cavity is defined by a body of the container having a base and a sidewall extending from the base, the body being configured to hold the product, the body further having an opening in communication with the second cavity through which a user may remove the amount of the product using the utensil.

6. The method of claim 5, wherein the first cavity is on a lid that is removably attachable to the body and is configured to close the opening when the lid is attached to the body, the lid having a basewall and further having a skirt extending from an outer periphery of the basewall, the lid further having at least one projection extending from the basewall and forming the housing, the at least one projection being spaced inwardly from the skirt, the lid further having an active agent situated on an inner portion of the at least one projection.

7. The method of claim 6, wherein the utensil has a portion thereof configured to seat on the at least one projection and to shield the active agent from the environmental trigger, the utensil being removably attachable to the at least one projection.

8. The method of claim 6, wherein the at least one projection is in the form of an annular member which forms the housing and defines the first cavity, the active agent being positioned within the first cavity.

9. The method of claim 6, wherein the active agent is press fit into the inner portion of the at least one projection.

10. The method of claim 1, wherein the active agent is provided as a unitary component made of a single piece of material.

11. The method of claim 5, wherein the second cavity comprises a lower compartment configured to hold the product and an upper compartment;

wherein the container includes a foil layer that is attached to the body and that separates the upper compartment from the lower compartment; and the utensil is situated within the upper compartment when the lid is attached to the body.

* * * * *